US011965333B2

(12) United States Patent
Lin

(10) Patent No.: US 11,965,333 B2
(45) **Date of Patent: *Apr. 23, 2024**

(54) MODULAR FRAMING STRUCTURE DESIGN AND A METHOD OF USING THE SAME

(71) Applicant: Wei-Jan Lin, Alhambra, CA (US)

(72) Inventor: Wei-Jan Lin, Alhambra, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/121,961

(22) Filed: Mar. 15, 2023

(65) Prior Publication Data

US 2023/0212855 A1 Jul. 6, 2023

Related U.S. Application Data

(63) Continuation of application No. 17/400,113, filed on Aug. 12, 2021, now Pat. No. 11,629,495.

(60) Provisional application No. 63/080,146, filed on Sep. 18, 2020.

(51) Int. Cl.

| | |
|---|---|
| ***E04C 3/32*** | (2006.01) |
| ***E04B 1/38*** | (2006.01) |
| ***E04B 1/58*** | (2006.01) |
| ***E04C 3/30*** | (2006.01) |

(52) U.S. Cl.

CPC ..... *E04C 3/32* (2013.01); *E04B 1/388* (2023.08); *E04B 1/5806* (2013.01); *E04C 3/30* (2013.01); *E04B 2001/5887* (2013.01)

(58) Field of Classification Search

CPC ..... E04C 3/32; E04C 3/30; E04B 1/40; E04B 1/585; E04B 2/7827; E04B 2/7845; E04B 1/5806; E04B 2001/5881; E04B 1/388

See application file for complete search history.

(56) References Cited

U.S. PATENT DOCUMENTS

| | | | | |
|---|---|---|---|---|
| 3,086,627 A * | 4/1963 | Bernard | E04B 2/744 | 52/474 |
| 3,143,981 A * | 8/1964 | Tassell | A47B 57/54 | 248/297.21 |
| 3,782,048 A * | 1/1974 | Corman | A47B 96/1475 | D25/120 |
| 4,065,904 A * | 1/1978 | Taylor | E04B 2/7854 | 248/245 |
| 4,073,113 A * | 2/1978 | Oudot | F16B 7/0486 | 403/189 |
| 4,101,231 A * | 7/1978 | Streib | F16B 7/046 | 403/DIG. 7 |
| 4,345,849 A * | 8/1982 | Stenemann | F16B 7/046 | 403/252 |
| 4,455,103 A * | 6/1984 | Hackenberg | F16B 7/0473 | 403/217 |
| 4,493,172 A * | 1/1985 | Jones | E04B 2/7845 | 52/220.1 |

(Continued)

*Primary Examiner* — Rodney Mintz

(74) *Attorney, Agent, or Firm* — WPAT, PC

(57) ABSTRACT

A modular structure system of detachable members, the system includes a support pillar and various connectors. The support pillar has a main body and a plurality of channel walls outwardly radiating from an outside surface of the main body. The channel walls are disposed lengthwise on the main body from one terminal end of the main body to another terminal end of the main body. The support pillar has a symmetrical cross-sectional shape and each of the channel walls has an expanded distal end forming two lips.

13 Claims, 20 Drawing Sheets

(56) References Cited

U.S. PATENT DOCUMENTS 4,583,359 A * 4/1986 Staeger ..... E04B 2/7845 403/255
4,585,131 A * 4/1986 Crossman ..... A47B 96/1475 D25/123
4,805,365 A * 2/1989 Bastian ..... E04B 2/744 52/282.2
4,941,763 A * 7/1990 Euteneuer ..... E04B 2/744 403/3
4,974,987 A * 12/1990 Smock ..... F16B 7/046 403/255
5,143,474 A * 9/1992 Vieler ..... F16B 7/046 403/252
5,429,438 A * 7/1995 Wood ..... F16C 29/02 384/42
5,464,298 A * 11/1995 Schomakers ..... F16B 7/0473 403/255
5,651,630 A * 7/1997 Nomura ..... F16B 7/187 403/219
5,690,239 A * 11/1997 Ballard ..... A47F 5/106 211/187
5,791,806 A * 8/1998 Giehl ..... E04H 1/1272 403/381
6,185,887 B1 * 2/2001 Strassle ..... A47B 57/045 403/231
6,481,177 B1 * 11/2002 Wood ..... F16B 12/50 403/231
6,682,255 B2 * 1/2004 Battaglia ..... A47F 5/14 403/381
6,802,171 B2 * 10/2004 McKinnon ..... E04C 3/32 52/762
6,955,016 B1 * 10/2005 Churches ..... E04B 1/04 52/745.12
7,389,621 B2 * 6/2008 Hawes ..... E04G 21/242 52/843
7,823,347 B1 * 11/2010 Blinn ..... E04G 21/24 182/186.7
8,209,917 B1 * 7/2012 DeZaio ..... E04B 2/7407 52/285.3
9,797,426 B2 * 10/2017 Flaig ..... B23P 19/04
10,662,650 B2 * 5/2020 Lacroix ..... E04C 3/06
11,629,495 B2 * 4/2023 Lin ..... E04B 1/5806 52/845
2002/0023391 A1 * 2/2002 Nymark ..... E04B 2/7453 211/94.01
2002/0122691 A1 * 9/2002 Wood ..... F16B 5/0685 403/381
2004/0074204 A1 * 4/2004 McKinnon ..... A47B 96/1466 52/781
2005/0210814 A1 * 9/2005 Hawes ..... E04G 21/28 52/648.1
2009/0049776 A1 * 2/2009 Lim ..... E04C 2/06 52/223.7
2014/0294498 A1 * 10/2014 Logan ..... A47B 47/042 403/376
2015/0010343 A1 * 1/2015 Flaig ..... F16B 7/0433 29/525.01
2019/0127978 A1 * 5/2019 Lacroix ..... E04C 3/06
2021/0301530 A1 * 9/2021 Faridnia ..... E04C 5/0609
2022/0090381 A1 * 3/2022 Lin ..... E04B 1/5806
2022/0112717 A1 * 4/2022 Mazza ..... E04C 3/28
2023/0088896 A1 * 3/2023 Lin ..... E04C 3/32 52/506.01

* cited by examiner

MODULAR FRAMING STRUCTURE DESIGN AND A METHOD OF USING THE SAME

CROSS-REFERENCE TO RELATED APPLICATIONS

This application is continuation of U.S. patent application Ser. No. 17/400,113, filed on Aug. 12, 2021, which claims priority to, and is a non-provisional patent application of, U.S. provisional patent application No. 63/080,146, filed on Sep. 18, 2020, which is hereby incorporated by reference in its entirety.

Although incorporated by reference in its entirety, no arguments or disclaimers made in the parent application apply to this application. Any disclaimer that may have occurred in the above-referenced application is hereby expressly rescinded.

FIELD OF THE DISCLOSURE

The present disclosure relates to a system of modular framing structure, more particularly, a system of pillars and connectors all of which are capable of providing a framing system onto which other accessories and equipment may be attached. Although the present disclosure is suitable for a wide scope of applications, it is particularly suitable for stage-building or to build any type of temporary (e.g., a tradeshow display), semi-temporary, and even permanent structure.

BACKGROUND OF THE DISCLOSURE

Generally, the current European and American standard aluminum extrusions for stage building are based on the same square and slot design using the "external lips" as the main structural support for accessories and fixtures. These types of prior art designs are known to fail easily.

There remains a need for better structurally-sound stage-building aluminum extrusions.

Further, there is an apparent need for a new structural system for stage building as well as for any type of structure-building, whether the structure is temporary, semi-temporary, or permanent. The herein disclosed embodiments may seek to satisfy one or more of the above-mentioned needs.

All referenced patents, applications and literatures are incorporated herein by reference in their entireties. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned needs. Although the present embodiments may obviate one or more of the above-mentioned needs, it should be understood that some aspects of the embodiments might not necessarily obviate them.

BRIEF SUMMARY OF THE DISCLOSURE

In a general implementation, a modular structure system of detachable members, the system includes a support pillar with a main body and a plurality of channel walls outwardly radiate from the outside surface of the main body and are disposed lengthwise on the main body from a first terminal end of the main body to a second terminal end of the main body.

In another aspect combinable with the general implementation, the support pillar can have a symmetrical cross-sectional shape.

In another aspect combinable with the general implementation, the plurality of channel walls can define a plurality of channels.

In another aspect combinable with the general implementation, each of the plurality of channel walls can have an expanded distal end to form two lips each of which are disposed on opposing sides of the channel wall.

In another aspect combinable with the general implementation, each of the plurality of channels can have a channel floor which is part of the outside surface of the main body;

In another aspect combinable with the general implementation, a plurality of holes can be disposed along each channel floor at least one of which can receive a fastener. In another aspect combinable with the general implementation, the main body of the support pillar can have a center bore disposed lengthwise from the first terminal end of the main body to the second terminal end of the main body.

In another aspect combinable with the general implementation, the main body of the support pillar can be entirely solid and not hollow.

In another aspect combinable with the general implementation, there can be a connecting core to fittingly receive within the center bore of the support pillar.

In another aspect combinable with the general implementation, the connecting core can have a cross-sectional profile that is substantially similar to a cross-sectional profile of the center bore.

In another aspect combinable with the general implementation, the connecting core can have a plurality of threaded holes at least one of which can receive a fastener.

In another aspect combinable with the general implementation, the plurality of holes of the channel floor can be through holes wherein at least some of which correspond with at least some of the threaded holes of the connecting core in at least one of size, position, and thread.

In another aspect combinable with the general implementation, the connecting core can be substantially shorter than a support pillar and is capable of connecting one terminal end of one support pillar to a terminal end of another support pillar.

In another aspect combinable with the general implementation, the connecting core can be made of a material harder than a material of the support pillar, such that once the connecting core is received into the center bore of the support pillar, the structural integrity of the support pillar is improved.

In another aspect combinable with the general implementation, the material of the connecting core includes at least one of carbon steel and tungsten steel.

In another aspect combinable with the general implementation, there can be a connector partially or fully received within the channel. Such a connector can be a binding connector or an accessories connector.

In another aspect combinable with the general implementation, the connector can have a bottom surface and can have at least one through hole. The at least one through hole of the connector can be disposed on the bottom surface of the connector to receive a fastener.

In another aspect combinable with the general implementation, the bottom surface of the connector can make direct contact with the channel floor of the support pillar when the connector is received and fastened within the channel of the support pillar.

In another aspect combinable with the general implementation, the at least one through hole of the connector corresponds with at least one of the plurality of holes of the channel floor in at least one of size, position, and thread.

In another aspect combinable with the general implementation, an accessories fastener can be inserted into the at least one through hole of the connector from the bottom surface of the connector such that a head of the accessories fastener is embedded within the connector while a portion of a shank of the accessories fastener is exposed and extends radially away from the support pillar. The portion of the shank can be attached to an accessory.

In another aspect combinable with the general implementation, at least one hole of the connector has at least one of a sink and countersink.

In another aspect combinable with the general implementation, the connector can have at least two holes wherein one of the at least two holes can receive a fastener as the fastener is fastened into the hole disposed on the channel floor. Another hole of the at least two holes can receive an accessories fastener inserted therethrough from the bottom surface such that the head of the accessories fastener is disposed at or near the bottom surface of the connector while a portion of a shank of the accessories fastener is exposed and extends radially away from the support pillar.

In another aspect combinable with the general implementation, the connector can have a cross-sectional profile that substantially corresponds with a cross-sectional profile of the channel of the support pillar in fitting and/or shape.

In another aspect combinable with the general implementation, the connector can have a secondary channel disposed lengthwise on a top side of the connector.

In another aspect combinable with the general implementation, there can be an end piece with a first core insert coupled to a head portion. The core insert can be sized to receive within the center bore of the support pillar while the head portion is exposed and remains connected to the first terminal end of the support pillar. There can be a plurality of threaded holes disposed on the core insert and/or the head portion.

In another aspect combinable with the general implementation, the head portion of the end piece can have a surface being flush with the channel floor of the support pillar.

In another aspect combinable with the general implementation, there can be a second core insert coupled to the head portion of the end piece on a side opposite to the first core insert.

In another aspect combinable with the general implementation, there can be provided an anti-slip striation or groove disposed on an exterior surface of the lips.

Accordingly, the present disclosure is directed to a modular framing structure that substantially obviates one or more problems due to limitations and disadvantages of the related art.

The many specific implementation details in this disclosure should not be construed as limitations on the scope of any inventions or of what may be claimed but rather as descriptions of features specific to particular implementations of particular inventions.

Certain features that are described in this specification in the context of separate implementations can also be implemented in combination in a single implementation. Conversely, various features that are described in the context of a single implementation can also be implemented in multiple implementations separately or in any suitable subcombination.

The detail of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

Figure 1A:
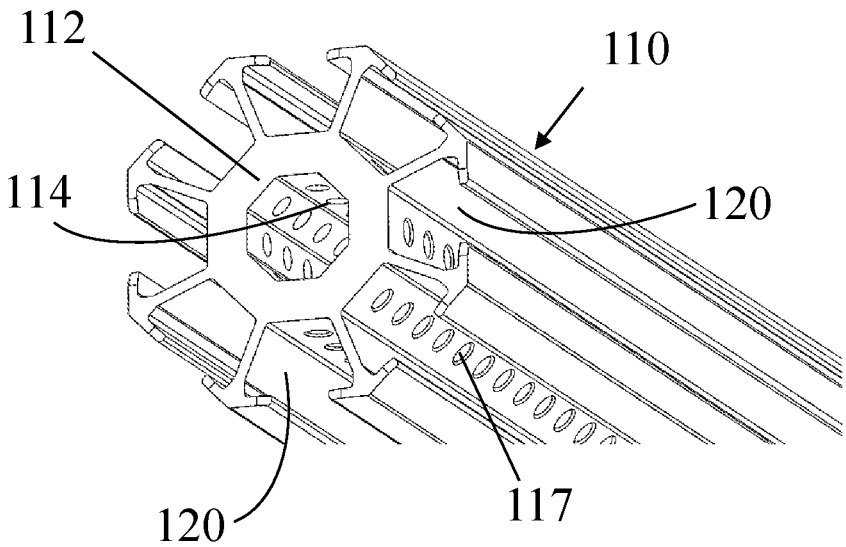
FIG. 1A is an enlarged perspective view of a contemplated embodiment of a terminal end of a support pillar, according to an aspect of the disclosure.

The following call-out list of elements in the drawing can be a useful guide when referencing the elements of the drawing figures:

100 Modular Structure System
101 Fastener
102 Accessory
110 Support Pillar
112 Main Body
114 Center Bore
117 Hole
120 Channel Wall
121 Channel
122 External Lip
123 Channel Floor
125 Channel Opening
130 Expanded Distal End of the Channel Wall
138 Anti-Slip Striation
140 Connecting Core
147 Hole
150 Binding Connector
151 Secondary Channel
152 Recess
154 Bottom Floor
156 Bottom Side
157 Hole
160 Accessories Connector
161 Secondary Holes
165 Tolerance
167 Hole
169 Counter Sink
170 End Piece
171 Exposed Face
172 Head Portion
174 Core Insert
177 Hole
179 Mounting Hole

DETAILED DESCRIPTION OF THE EMBODIMENTS

The different aspects of the various embodiments can now be better understood by turning to the following detailed description of the embodiments, which are presented as illustrated examples of the embodiments as defined in the claims. It is expressly understood that the embodiments as defined by the claims may be broader than the illustrated embodiments described below.

The inventor has discovered a novel modular framing system for any conceivable structure that requires the use of some kind of underlying framing or truss.

In one aspect, the inventor has discovered that when prior art extrusion parts are under stress, their external lips almost always experience a larger deformation and more displacement than the center portion of the extrusion. The inventor has discovered that the external lips (see FIG. 7) are not the best location to mount fixtures.

Referring now to FIG. 1A, the contemplated system 100 (see FIG. 15 as one example) of modular frame structure includes one or more support pillars 110 all of which can act as a major backbone of the modular frame structure. FIG. 1A shows a terminal end of the contemplate support pillar 110. Here, the support pillar 110 can generally have an octagonal cross-sectional shape. In some embodiments, the support pillar 110 can have an octagonal cross-sectional shape but the disclosure is not limited thereto. In some embodiments, the support pillar 110 can have a square or rectangular cross-sectional shape but the disclosure is not limited thereto. In some embodiments, the support pillar 110 can have a circular cross-sectional shape but the disclosure is not limited thereto. In some embodiments, the support pillar 110 can have a polygonal cross-sectional shape but the disclosure is not limited thereto. In some embodiments, the support pillar 110 can have a symmetrical polygonal cross-sectional shape but the disclosure is not limited thereto.

As used herein, the term "support pillar" is sometimes referred to in the industry as an aluminum extrusion. It should be particularly noted that the support pillar may be made of aluminum or other materials and can be manufactured by way of extrusion or other means. For example, the support pillar 110 can be formed by extrusion, casting, CNC machining, or other known shaping methods. The materials of the support pillar 110 can be metal, ceramic, plastics, composite materials, any natural or synthetic material, and any mixture of the above materials. Additionally, the support pillar 110 may be surface treated by any known methods such as sandblasting, anodizing, and by any known heat treatment methods such as T6 and T651. Any other combination of known surface treatments and heat treatments are particularly contemplated to strengthen any threaded holes.

Depending on the intended uses, any of the contemplated parts in this disclosure can be made of a suitable material to withstand temperature extremes and chemical extremes, such materials include natural and synthetic polymers, various metals and metal alloys, naturally occurring materials, ceramic materials, and all reasonable combinations thereof.

In FIGS. 1A-1E, the support pillar 110 generally has a main body 112 through the entire length of the support pillar 110. Radiating from the main body 112 there can be a plurality of channel walls 120. Each channel wall 120 can have a length from one terminal end of the support pillar 110 to the opposite terminal end of the support pillar 110. In some embodiments, the channels walls 120 are equally spaced apart from each other.

Figure 1B:
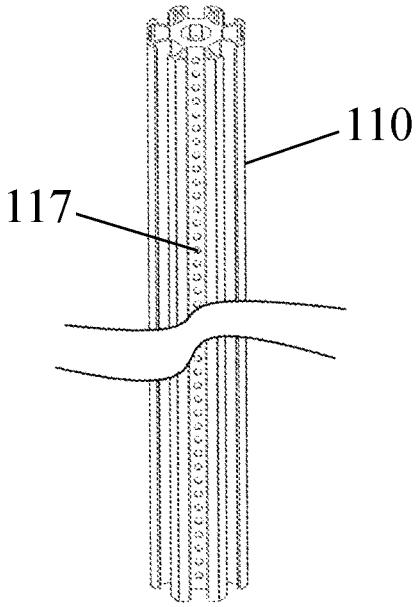
FIG. 1B is a perspective view of a contemplated embodiment of a support pillar, according to an aspect of the disclosure.
Figure 1C:
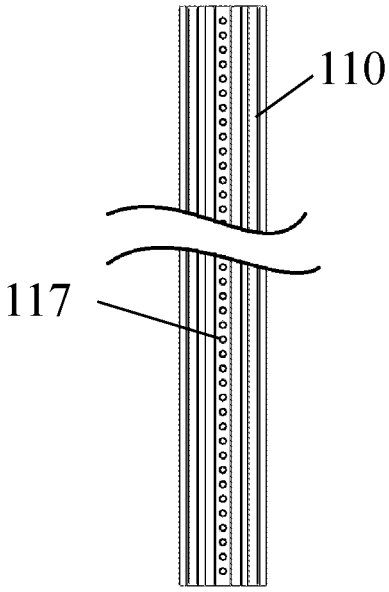
FIG. 1C is a side view of the support pillar of FIG. 1B, according to an aspect of the disclosure.
Figure 1D:
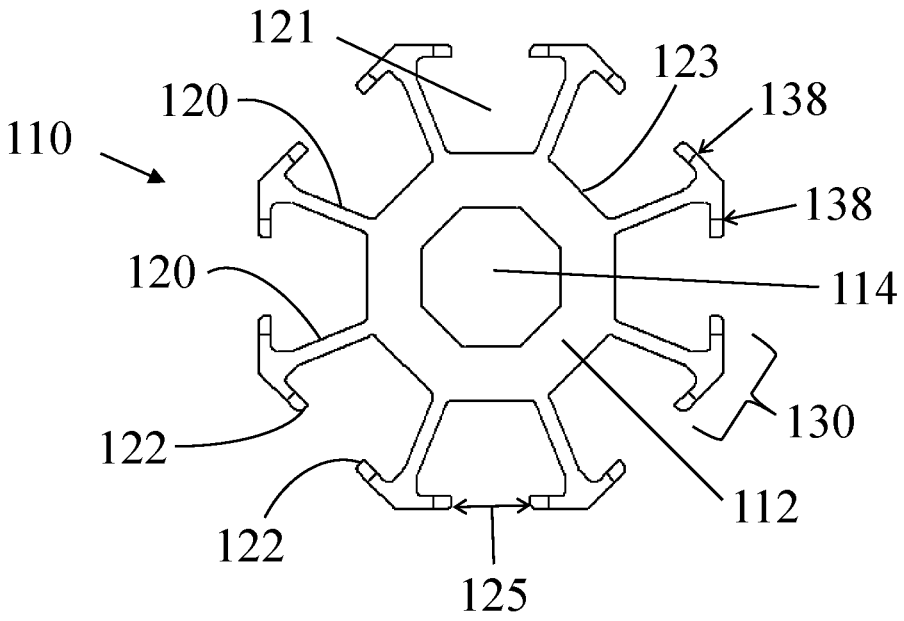
FIG. 1D is an enlarged cross-section view of an embodiment of the contemplated support pillar showing a hollow center bore, according to an aspect of the embodiment.

In some embodiments such as those shown in FIGS. 1A, 1B, 1D, the support pillar 110 is contemplated to have a center bore 114 that spans through the entire length of the support pillar 110. In other words, the center bore 114 can be a hollow space within the main body 112 from one terminal end of the main body 112 to the opposite terminal end of the main body 112. At each terminal ends of the main body 112, the center bore fluidly connects to the outside environment via an opening such as the octagonal shaped opening in FIG. 1A. FIG. 1D is a view of a terminal end of the contemplated support pillar 110 showing an octagonal shaped opening of the center bore 114.

In one embodiment, a user may use the center bore 114 for cable or pipe management. As will be described below, the center bore 114 may also receive one or more core connectors 140 (see FIG. 2).

Figure 1E:
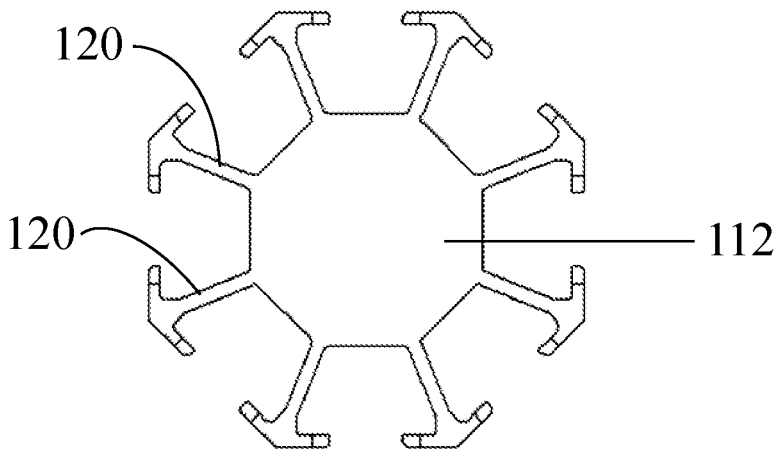
FIG. 1E is an enlarged cross-section view of another embodiment of the contemplated support pillar showing a solid main body without a center bore, according to an aspect of the embodiment.

In some embodiments such as that shown in FIG. 1E, the support pillar 110 is contemplated to have a main body 112 that is entirely solid and without any center bore 114. FIG. 1E is a view of a terminal end of a contemplated support pillar 110 showing the main body 112 having a solid center without any center opening for a center bore 114.

Whether or not the center bore 114 is present, the main body 112 is contemplated to have at least one row of consecutive holes 117 disposed lengthwise on the main body 112 in between two adjacent channel walls 120. As for the embodiment specifically shown in FIG. 1A, each of the holes 117 can be through holes disposed through the thickness of the main body 112 such that the center bore 114 can be fluidly connected to the space in between two adjacent channel walls via the through hole 117.

In another embodiment now shown in the figures, the row of consecutive holes 117 disposed lengthwise on the main body 112 cannot be through holes. For example, the holes 117 can be sufficiently shallow so each hole does not open through to reach the center bore 114. In still another embodiment where the main body 112 of the support pillar 110 has no center bore 114, the row of consecutive holes 117 cannot be through holes.

Also, in any of the embodiments discussed, these holes 117 on the channel floor 123 can be threaded or non-threaded holes. There can be any number of threaded/unthreaded holes. The threaded holes can include any known thread inserts or thread protections.

As shown in FIGS. 1B and 1C, a support pillar 110 is contemplated to have a length. The length of the support pillar 110 would be determined by each particular use. Therefore, the manufacturers can product support pillars 110 over various lengths to fulfill various uses. In the perspective view of FIG. 1B and side view of FIG. 1C, only one row of holes 117 are shown due to their angle of view. For an octagonal-shaped main body, there can actually be up to eight rows of holes 117 each row being disposed between two adjacent channel walls 120.

Referring now to FIG. 1D, the plurality of channel walls 120 can be disposed and equally spaced apart on the main body 112. The channel walls 120 radiate from the main body 112 and two adjacent channel walls 120 form a channel 121. A channel 121 is contemplated to be a track with two terminal ends being open at the two respective terminal ends of the support pillar 110. The top of each channel 121 is also open to the ambient environment via a channel opening 125. Channel opening 125 can have a width defined by the distance between two opposing the external lips. In other words, the channels 121 in the embodiments shown are similar to a trough having an elongated narrow configuration with an open top. In some embodiments, all of the contemplated channels cannot be closed channels (e.g., with its top being closed to the ambient environment). In some other embodiments, at least one of the channels can be closed while others remain open.

Each channel 121 can have a channel floor 123 which can be the outer surface of the main body 112. As described above, there can be a row of consecutive holes disposed on the channel floor 123.

Each channel wall 120 can have an expanded end 130. Various shapes are contemplated for the expanded end 130. In FIG. 1D, the expanded end 130 can be two extending external lips 122. Each external lip 122 can extend in a transverse direction from the radiating direction of the channel wall 120. On the outer side of each external lip 122 there can be disposed a striation 138 or groove. The striation 138 can minimize slippage of accessories attached to the support pillar 110.

The general cross-sectional shape of a channel 121 is defined by the shape of the channel floor 123, the channel wall 120, and the external lip 122. In FIG. 1D, the channel 121 has a cross-sectional shape of a trapezoid. Other shapes are also possible.

Figure 2:
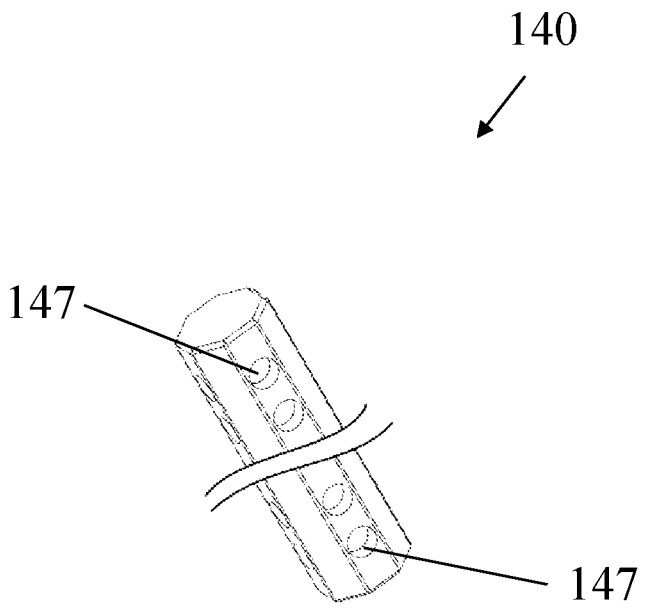
FIG. 2 is an enlarged perspective view of a contemplated embodiment of a core connector, according to an aspect of the disclosure.
Figure 16:
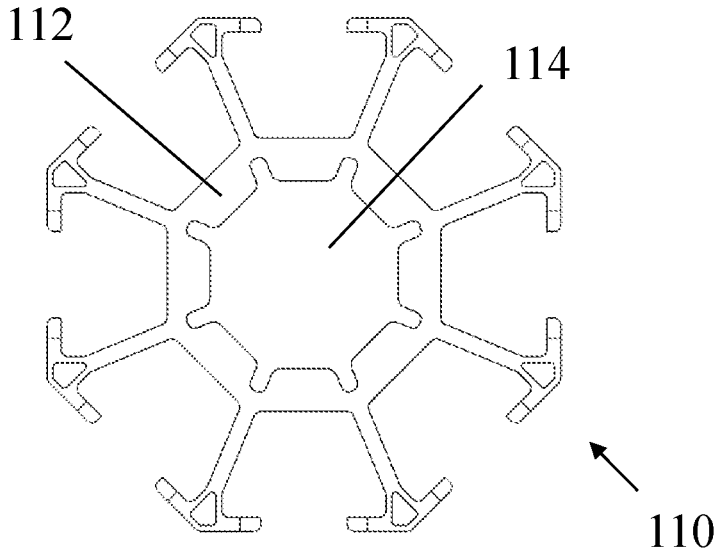
FIG. 16 is an enlarged cross-sectional view of another embodiment of the support pillar, according to one aspect of the disclosure.

Referring now to FIG. 2, which illustrates a connecting core 140. A connecting core 140 can have a cross-sectional shape and configuration that corresponds with the center bore 114 of the support pillar 110. The connecting core 140 is also contemplated to have other cross-sectional shapes such as circular, square, or other polygonal shapes even if its shape does not correlate with the shape of the center bore 114. For example, a round connecting core 140 can be used to receive within an octagonal center bore 114, especially if the diameter of the round connecting core 140 can adequately fit within the octagonal center bore 114 with a small or minimum tolerance. FIG. 16 discloses another embodiment of the main body 112 such that certain portions of the main body 112 can have a thinner profile. The thinner profile at various locations can reduce the overall weight, amount of material used, and/or cost of production. In turn, the cross-sectional shape of the center bore 114 may have outwardly radiating tips.

The connecting core 140 can have various lengths. In one embodiment, it can be much shorter than the length of the support pillar 110. In another embodiment, it can be about the same length as the support pillar 110. In yet other embodiments, it can be longer than the length of a support pillar 110.

Figure 3:
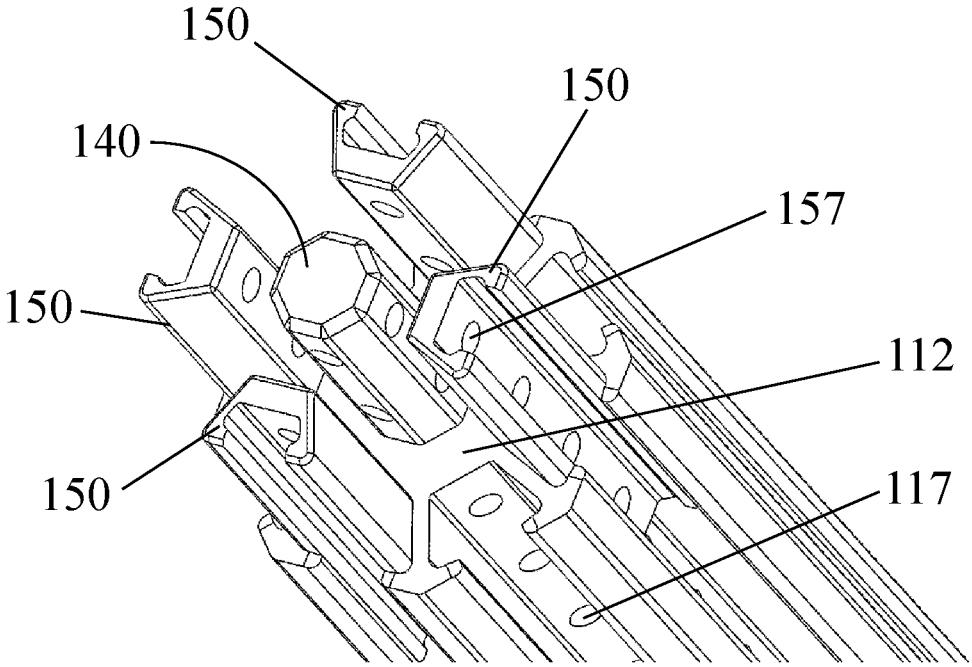
FIG. 3 is an enlarged perspective view of the first terminal end of a support pillar with four connectors and a connecting core all of which are partially inserted within the support pillar, according to an aspect of the disclosure.

The connecting core 140 shown in FIG. 2 has a row of holes 147 disposed consecutively lengthwise. In one embodiment, these holes 147 are equal-distant to each other. In another embodiment, some of these holes 147 are not evenly spaced apart. There can be at least one row of such holes 147. In one embodiment, there can be four rows of such holes 147 to correspond with the rows of through holes 117 on the support pillar 110. In this way, when the connecting core 140 is received either partially or entirely within the center bore 114 of a support pillar 110, the user may use one or more fasteners to secure the connecting core 140 in place. FIG. 3 illustrates one example of having a connecting core 140 received within the center bore 114 of a support pillar 110. The holes 147 shown in FIG. 2 can be threaded or non-threaded holes 147. The holes 147 in FIG. 2 are shown to have a relatively shallow depth thereby exposing the bottom of the holes 147 in FIG. 2. In another embodiment, the holes 147 can be deeper. In still another embodiment, the holes 147 in FIG. 2 can be through holes 147 that thoroughly connects opposite sides of the connection core 140.

Figure 8A:
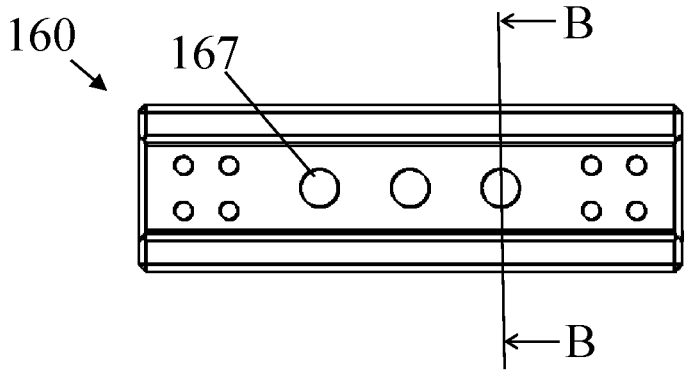
FIG. 8A is an enlarged top view of an embodiment of an accessories connector capable of attaching an accessory, according to an aspect of the disclosure.
Figure 8B:
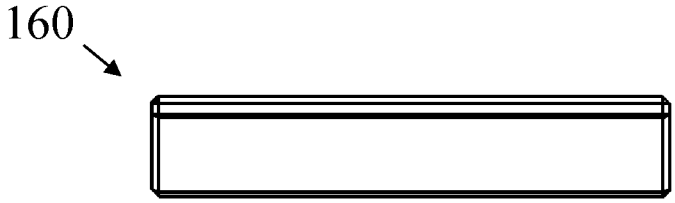
FIG. 8B is an enlarged side view of the accessories connector of FIG. 8A, according to an aspect of the disclosure.
Figure 8C:
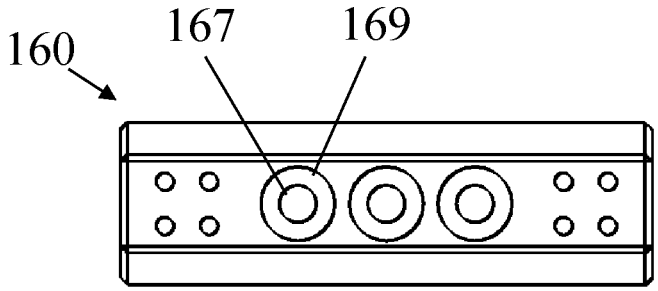
FIG. 8C is an enlarged bottom view of the accessories connector of FIG. 8A, according to an aspect of the disclosure.
Figure 8D:
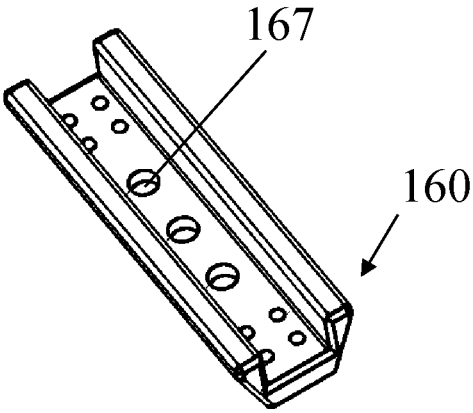
FIG. 8D is an enlarged perspective view of the accessories connector of FIG. 8A, according to an aspect of the disclosure.

FIG. 3 illustrates a support pillar 110 having a main body 112 with a center bore that receives a connecting core 140. Additionally shown in this figure are four binding connectors 150 partially received in their respective channels 121. As will be described below, a binding connector 150 can be fully received into a channel 121 and can freely move within the channel 121 in a lengthwise direction. In other embodiments, a binding connector 150 can not be fully received into a channel 121. As will be further described in other figures such as FIGS. 8A-8C, there can additionally be provided accessories connectors 160 that are similar to the binding connectors 150 in some ways yet different in other ways. A user may freely decide how many binding connectors 150 to use to couple two support pillars 110 end-to-end. In FIG. 3, four binding connectors 150 are used, thereby leaving four other channels 121 free so that any accessories connectors 160 (to be discussed below) located therein can freely slide from one support pillar 110 to an adjacent support pillar 110.

Figure 4A:
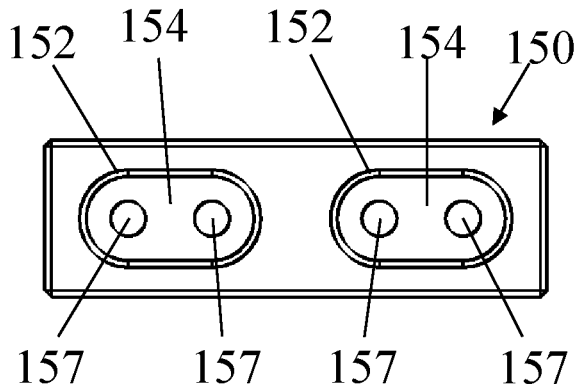
FIG. 4A is an enlarged top view of an embodiment of a binding connector capable of binding two support pillars end-to-end, according to an aspect of the disclosure.

FIGS. 4A-4F show another embodiment of a binding connector 150 each capable of being received within a channel 121 of a support pillar 110. FIG. 4A shows a top view of this particular binding connector 150. There can be two elongated oval shape trough recesses 152 disposed on the top side of the binding connector 150. Each recess 152 can have a bottom floor 154. There can be two through holes 157 disposed on each of the two bottom floors 154. Each through hole 157 can receive a fastener. A fastener such as a screw or a bolt may be inserted into the recess 152 and passed through the through holes 157. The head of the fastener can remain within the recess 152 while the distal end of the shank extends away from the bottom side 156 of the binding connector 150 and into a hole 117 on the main body 112 of the support pillar 110.

Figure 4B:
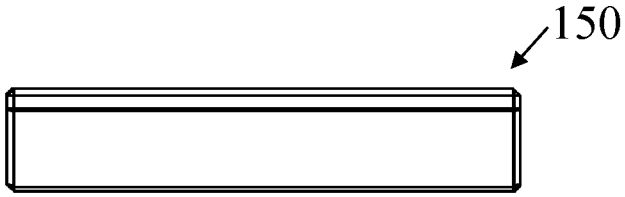
FIG. 4B is an enlarged side view of the binding connector of FIG. 4A, according to an aspect of the disclosure.
Figure 4C:
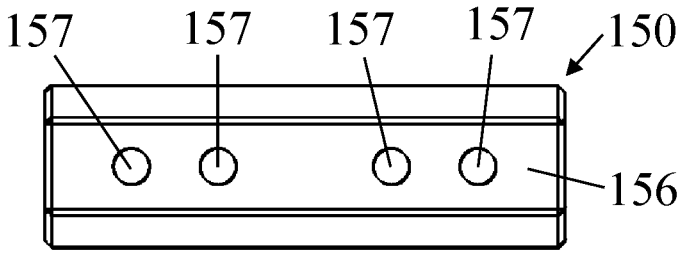
FIG. 4C is an enlarged bottom view of the binding connector of FIG. 4A, according to an aspect of the disclosure.
Figure 4D:
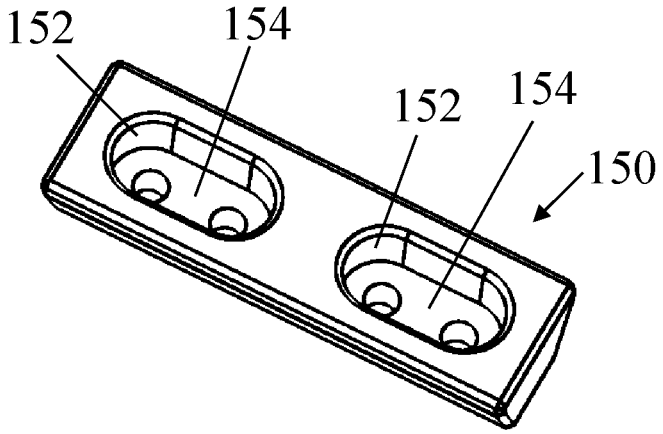
FIG. 4D is an enlarged perspective view of the binding connector of FIG. 4A, according to an aspect of the disclosure.

FIG. 4B shows a side view of the binding connector 150. Binding connectors 150 can have a straight flat top and a flat bottom side 156. Overall, the binding connector 150 is contemplated to have a cross-sectional shape that corresponds with a cross-sectional shape of the channel 121 such that the binding connector 150 can fittingly receive within the channel 121.

Figure 4E:
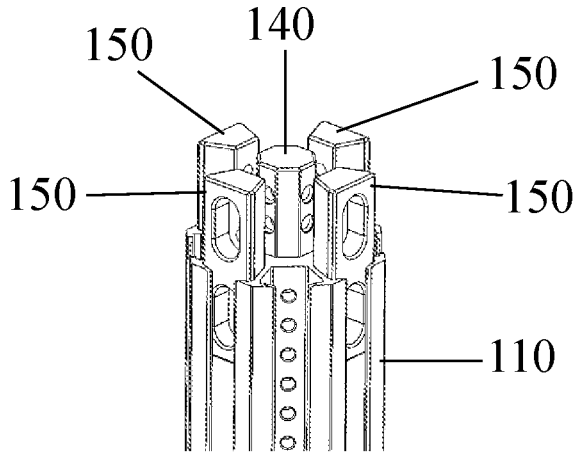
FIG. 4E is an enlarged perspective view of four of the binding connector of FIG. 4A being inserted into a terminal end of a support pillar, according to an aspect of the disclosure.

In FIG. 4E, four binding connectors 150 are partially inserted into four channels 121 of a support pillar 110. There is also a connecting core 140 partially inserted into the center bore 140. Fasteners can be used to fasten each binding connector 150 in place by inserting the fastener through a corresponding through hole 117 on the main body 112 and into a corresponding hole 127 of the connecting core 140.

Figure 4F:
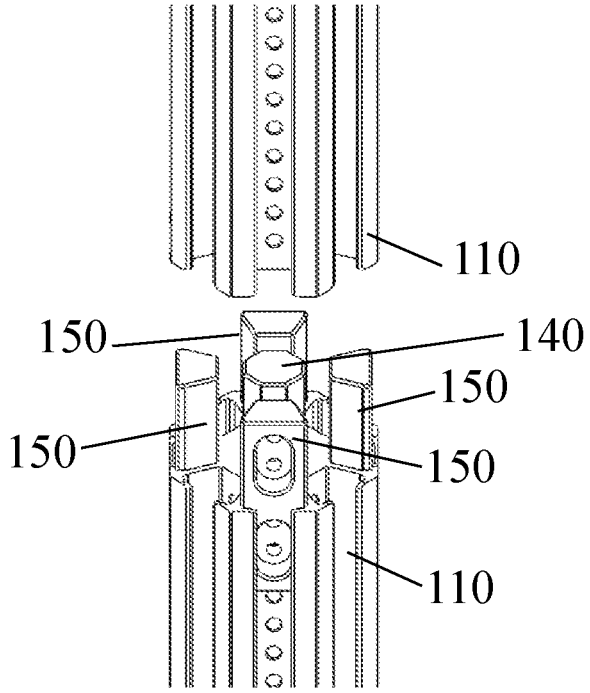
FIG. 4F is an enlarged perspective view of four of the binding connector of FIG. 4A being inserted into a terminal end of one support pillar while another support pillar is ready to be connected to them, according to an aspect of the disclosure.

Once the connecting core 140 and the four binding connectors 150 are fastened in place, another support pillar 110 can be attached thereon as shown in FIG. 4F. Similarly, one may use fasteners to fasten the four binding connectors 150 to the second support pillar 110. The connecting core 140 can be received within a corresponding center bore 114 in the second support pillar 110. In this way, many support pillars 110 can be fixed to one another end-to-end, creating a much longer support pillar 110.

Although four binding connectors 150 and one connecting core 140 are illustrated in FIG. 4F to connect two support pillars 110, the disclosure is not limited to this specific combination. Specifically contemplated methods to connect two support pillars 110 can implement any feasible combinations using any number of the binding connector 150 and any number of the connecting core 140.

As can be understood based on the above description, the binding connector 150 can bind two support pillars 110 together end-to-end. The configuration of the binding connector 150 shown in FIG. 4F can effectively separate one channel 121 from the channel 121 of another support pillar 110. In other words, an item that is slidably engaged within a channel 121 would be stopped from sliding over to the next support pillar 110 because the binding connector 150 is in the way, according to one aspect of the embodiments.

Figure 5A:
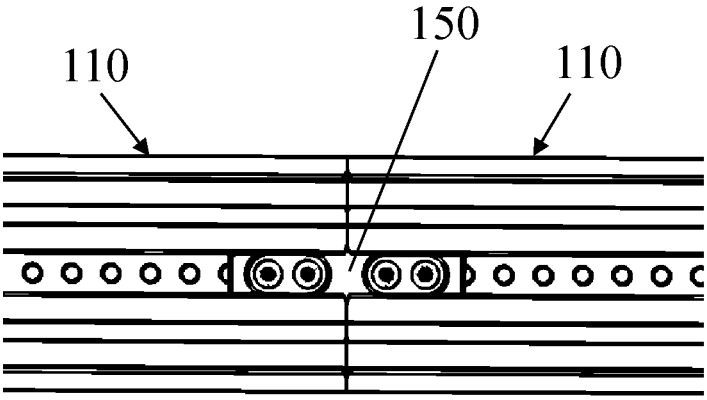
FIG. 5A is an enlarged top view of one embodiment of a binding connector having four individual recesses, and the binding connector binds two support pillars end-to-end, according to an aspect of the disclosure.
Figure 5B:
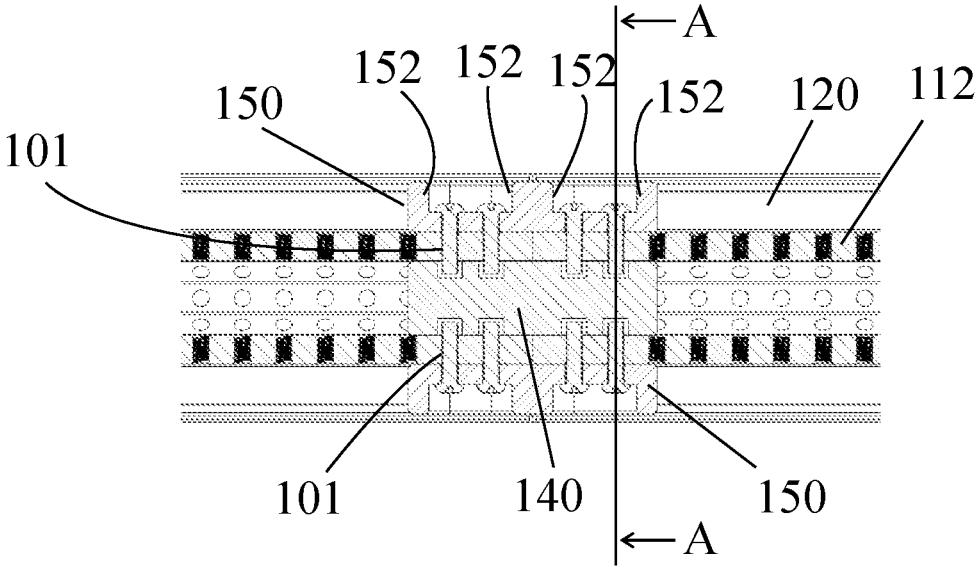
FIG. 5B is an enlarged longitudinal cross-sectional view of the embodiment of the binding connector of FIG. 5A having four individual recesses, the binding connector binds two support pillars end-to-end, according to an aspect of the disclosure.

FIGS. 5A-5B show another embodiment of the binding connector 150 where the binding connector 150 can have individual recesses 152, one for each 157 hole. There can be four recesses 152 to respectively receive four fasteners. FIG. 5A shows a top view wherein the binding connector 150 binds two support pillars 110 together end-to-end. FIG. 5B is a cross-sectional side view of what's shown in FIG. 5A. There is one binding connector 150 on the top side of the support pillar 110 and a binding connector 150 on the bottom side of the support pillar 110. A connecting core 140 is shown in the middle. Here, the four individual recesses 152 are shown for each binding connector 150. Each individual recess 152 is shown to have received a fastener 101.

When two or more support pillars 110 are connected end-to-end, the weakest point is expected to be where one terminal end joins another terminal end. This is particularly true when a bending force is applied to the support pillars 110. For example, the region shown in FIG. 5B can potentially be a weak point when a bending force is applied to the support pillars 110. The presence of channel walls 120 and external lips 122 can alleviate some of the otherwise great deal of stress applied on the fasteners 101 and the threaded holes 117 on the main body 112. In other words, if there were no channel walls 120 and external lips 122, the fasteners 101 would be more likely to pop out of the threaded holes 117. The channel walls 120 and external lips 122 can hold the binding connector 150 firmly in place thereby further minimizing any undesirable deformation.

Figure 6:
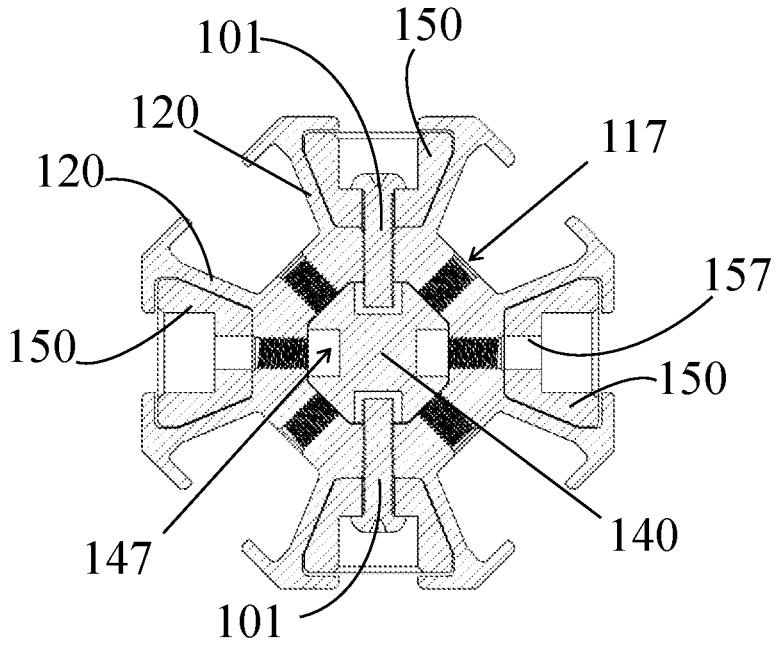
FIG. 6 is an enlarged cross-sectional view of the embodiment of the binding connector along line A-A in FIG. 5B.

FIG. 6 is a sectional view taken along line A-A in FIG. 5B and shows four binding connectors 150 each having a shape that snugly fits within a respective channel 121. Fastener 101 connects a binding connector 150 to the connecting core 140, sandwiching the main body 112 of the support pillar 110 in between. The two binding connectors 150 on the left and on the right are shown without their respective fasteners 101 to illustrate how they look without the fasteners 101. Fasteners 101, however, can be inserted through the through holes 157 into corresponding holes in the main body 112 and corresponding holes in the connecting core 140.

In FIG. 6, an exemplary binding connector 150 is shown where there is very little play or tolerance between the binding connector 150 and the channel walls 120 and/or external lips 122. It will, nevertheless, be understood that no limitation of the scope of the disclosure is thereby intended. It is particularly contemplated that in some embodiments, there can be some play or tolerance between a binding connector and its respective channel walls 120 and/or external lips 122. The same goes with FIG. 8E where an exemplary accessories connector 160 is shown where there is very little play or tolerance between an accessories connector 160 and the channel walls 120 and/or external lips 122. In any of the embodiments of this disclosure, there can be contemplated some play or tolerance between the binding connector/accessories connector and the channel walls 120 and/or external lips 122. One example of play or tolerance 165 is shown in FIG. 9E where some play or tolerance 165 is provided between the accessories connector 160 and the external lips 122. This tolerance 165 can be important and can allow for a binding connector 150 and accessories connector 160 to slide within a channel 121 even when the external lips 122 and/or the channel wall 120 is slightly bent in some areas. Among the many different possibilities contemplated, there can have a tolerance 165 of 0.05 to 4.0 mm. It is further contemplated that there can have a tolerance 165 of 0.05 to 2.0 mm. It is further contemplated that there can have a tolerance 165 of 0.10 to 1.0 mm. In other embodiments, it is contemplated that there can have a tolerance 165 of up to 0.5 mm. In yet other embodiments, it is contemplated that there can have a tolerance 165 of 0.01 mm to 10.0 cm. Other sizes of tolerance are also contemplated depending on the size of the channel 121.

Figure 7:
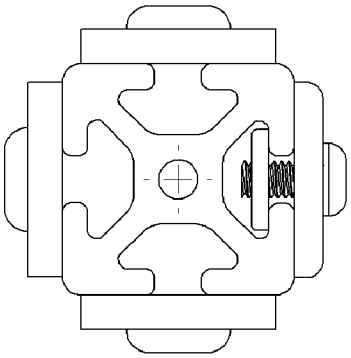
Fig. 7 PRIOR ART
FIG. 7 is an enlarged cross-sectional view of a prior art device where accessories are anchored to the lips.

Referring now to FIG. 7 showing a prior art aluminum extrusion where an accessory is clamped on. The accessory here is clamped using a screw and a plate. By fastening the screw, the external lips are sandwiched between the accessory and the plate. The inventor has discovered that the attachment of an accessory to this prior art aluminum extrusion is only as strong as the external lips are against bending. In an example, an accessory, such as a large heavy camera that was originally installed onto a prior art aluminum extrusion at a particular angle relative to the aluminum extrusion, can undesirably bent the external lips to which the camera is attached to. Over time, the large heavy camera would no longer be at the originally-intended angle relative to the aluminum extrusion. Also, if the clamping provided by the screw and the plate becomes loose, the camera may slide to a different location along the length of the extrusion.

It is particularly contemplated that in one embodiment, the support pillar 110 can similarly allow an accessory to be clamped onto its lips 122 in the same way as described in FIG. 7.

Alternatively, in the contemplated systems disclosed herein, an accessory can be attached to a support pillar 110 using an accessories connector 160 which will be described below relating to FIGS. 8A-8E, 9A-E, 10A-10D, 11A-11C. In some of these embodiments, the mounting of an accessory can place less mechanical stress on the external lips 122. In some embodiments, the mounting of an accessory can place more mechanical stress on the main body 112 of the support pillar 110. In some other embodiments, the mechanical stress of mounting an accessory can be distributed between the main body 112 of the support pillar 110, the channel wall 120, and the external lips 122.

Figure 8E:
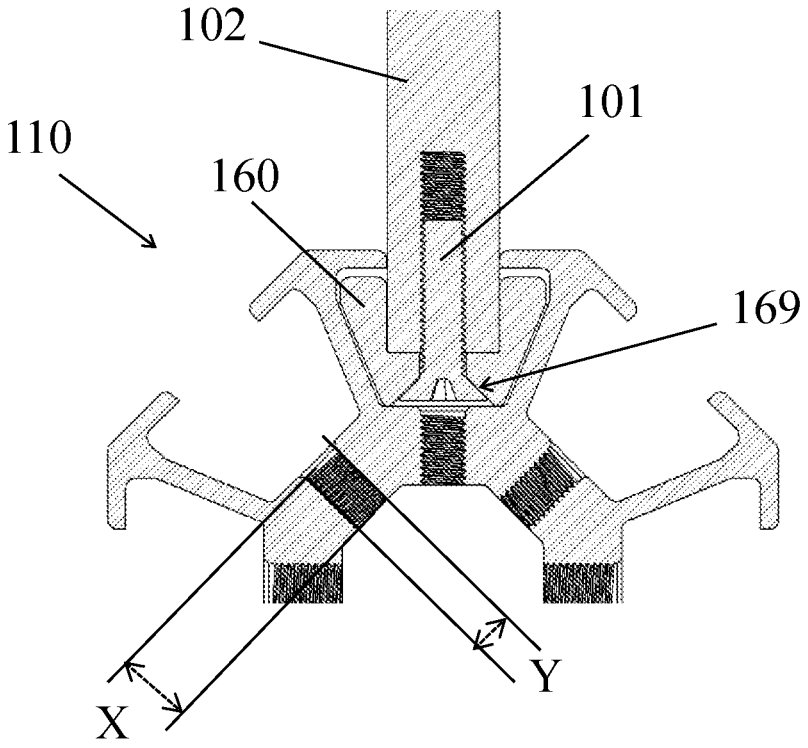
FIG. 8E is an enlarged cross-sectional view along line B-B in FIG. 9A, shown additionally with a fastener and an accessory, according to an aspect of the disclosure.

In FIGS. 8A-8E, an exemplary accessories connector 160 is shown having three holes 167 and eight secondary holes 161. The underside (see FIG. 8C) of the accessories connector 160 shows a countersink 169 provided for each of the three holes 167. The countersink 169 can allow a fastener 101 to flush-mount through the holes 167 as shown in FIG. 8E. In one embodiment, the countersink 169 provides very little tolerance between the head of the fastener 101 and the channel floor 123 (see FIG. 8E). In this way, if the fastener 101 is inadvertently loosen during operation, the fastener 101 can only retract so far. FIG. 8E is a cross-sectional view taken at line B-B of FIG. 8A with the addition of a support pillar 110, a fastener 101, and an accessory 102 in the shape of a plate. This fastener 101 has its shank extending away from the support pillar 110 and can be used to attach (directly or indirectly) to an equipment (e.g., cameras, sensors, signs, lighting equipment, speakers). Referring back to FIGS. 8A-8D, the eight secondary holes 161 can be threaded and they are provided and can each receive a fastener from the top side of the accessories connector 160 and inserted toward the channel floor 123. These eight secondary holes 161 can be offset from the location of the holes 117 of the main body 112. When an appropriately-sized fastener 101 is inserted through a secondary hole 161 and has eventually reached the channel floor, continued fastening can cause the fastener 101 to push the accessories connector 160 towards the lips 122 thereby securing the accessories connector 160 in place. This arrangement can allow the accessories connector 160 to be secured at any location within a channel 121 without the need to correspond to the holes 117 of the main body 112.

This exemplary accessories connector 160 has eight secondary holes 161, while any number of secondary holes are particularly contemplated. Further, these secondary holes can be located anywhere on the accessories connector 160 even at locations where they would correspond with the location of a hole 117 of the main body 112. Also, any size of the secondary hole 161 can be used, including the same size as the size of the hole 167.

In FIG. 8E, the fastener 101 having its shank extending upwards towards an accessory 102 which can be a plate as shown. The plate can have threaded holes to receive the fastener 101. This plate 102 can be fittingly received in the channel of the accessories connector 160. The distance between the two opposing outer lips can be at the same distance as the width of the channel of the accessories connector 160, wherein the plate 102 can be in direct contact with the two opposing outer lips. In this way, the opposing lips can provide additional structural support to improve the integrity of the system. Another accessory can then attach to this plate, in some particular embodiments.

In any of the herein disclosed embodiments, the main body 112 can have a certain thickness of solid mass (whether or not the embodiment has a center bore 114) such that each of the plurality of holes 117 disposed along each channel floor 123 and disposed into the thickness of the main body 112 can have a certain depth (X) to diameter (Y) ratio (see FIG. 8E). In some embodiments, the ratio of depth (X) to diameter (Y) is between and including 0.5:1 and 3:1 but the disclosure is not limited thereto. In some embodiments, the ratio of depth (X) to diameter (Y) is between and including 1:1 and 2:1 but the disclosure is not limited thereto. In some other embodiments, the ratio of depth (X) to diameter (Y) is between and including 1.3:1 and 1.8:1 but the disclosure is not limited thereto. In some other embodiments, the ratio of depth (X) to diameter (Y) is between and including 1.5:1 and 1.7:1 but the disclosure is not limited thereto. In one other embodiment, the ratio of depth (X) to diameter (Y) is 1.25:1, but the disclosure is not limited thereto. In another embodiment, the ratio of depth (X) to diameter (Y) is 1.5:1, but the disclosure is not limited thereto. In still another embodiment, the ratio of depth (X) to diameter (Y) is 1.75:1, but the disclosure is not limited thereto. These contemplated ratios of depth (X) to diameter (Y) can provide sufficient anchoring strength when a fastener 101 is fastened into the hole 117. In another embodiment, the depth (X) can be sufficiently thick to fit thread inserts.

Figure 9A:
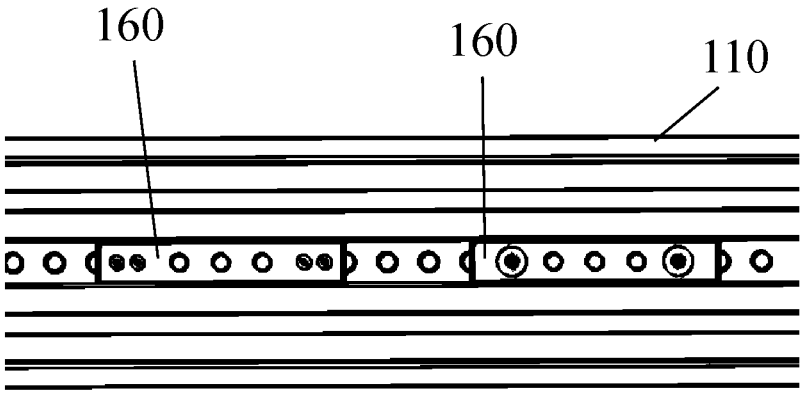
FIG. 9A is an enlarged top view of two different accessories connectors received within the same channel of a support pillar, according to an aspect of the disclosure.
Figure 9B:
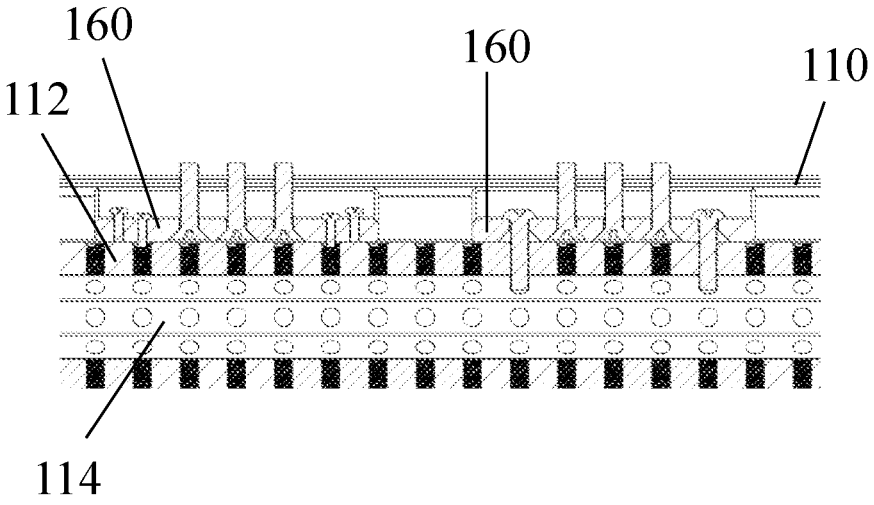
FIG. 9B is an enlarged longitudinal cross-sectional view of FIG. 9A, according to an aspect of the disclosure.
Figure 9C:
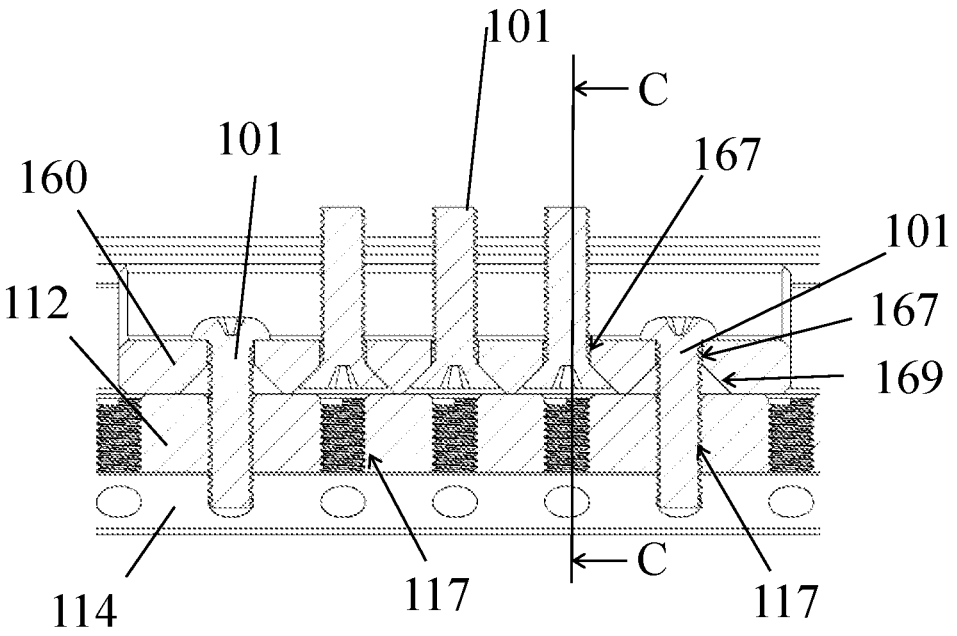
FIG. 9C is an enlarged view of the connector on the right in FIG. 9B, according to an aspect of the disclosure.
Figure 9D:
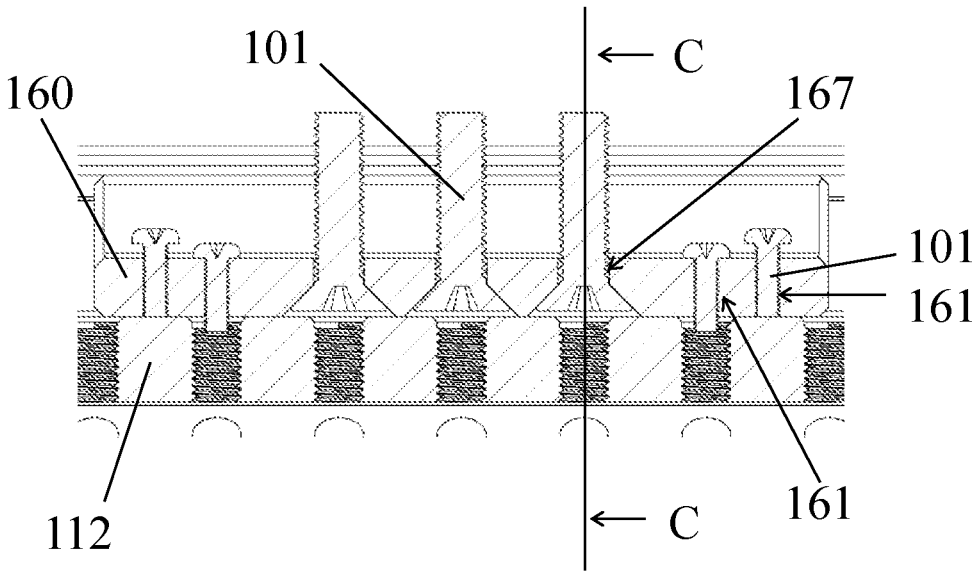
FIG. 9D is an enlarged view of the connector on the left in FIG. 9B, according to an aspect of the disclosure.
Figure 9E:
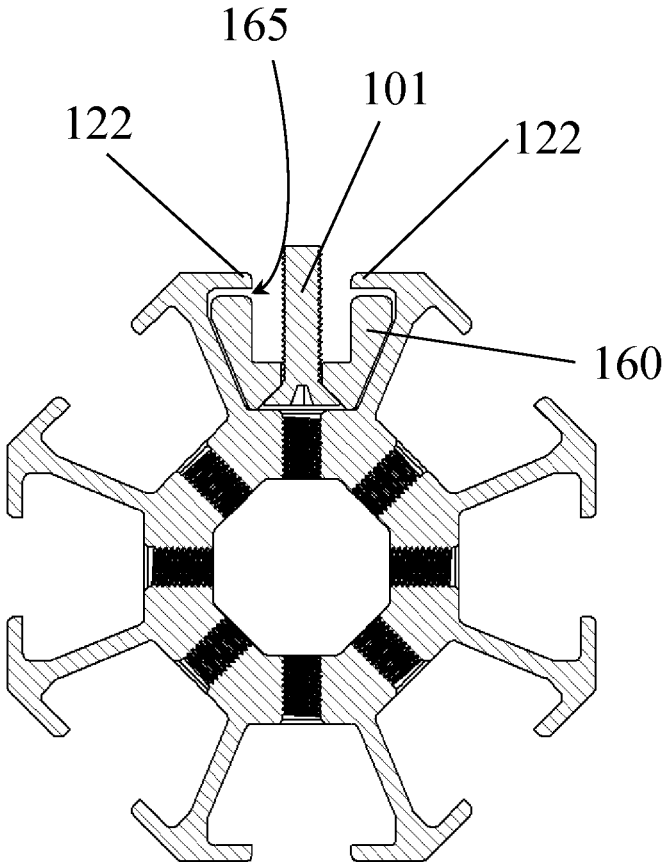
FIG. 9E is an enlarged view cross-sectional of line C-C of FIGS. 9C and 9D, according to an aspect of the disclosure.
Figure 10A:
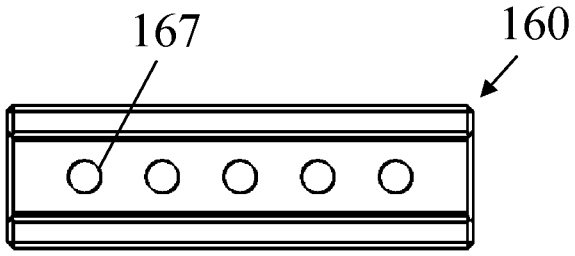
FIG. 10A is an enlarged top view of the accessories connector of FIG. 9C, according to an aspect of the disclosure.
Figure 10B:
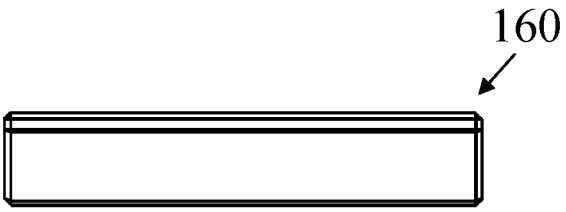
FIG. 10B is an enlarged side view of the accessories connector of FIG. 9C, according to an aspect of the disclosure.
Figure 10C:
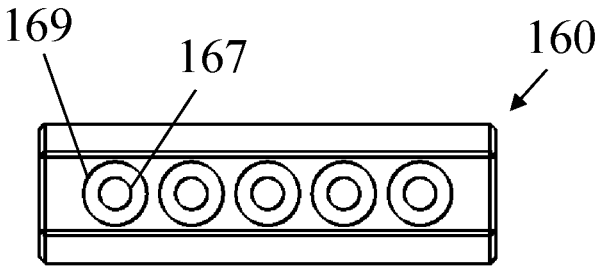
FIG. 10C is an enlarged bottom view of the accessories connector of FIG. 9C, according to an aspect of the disclosure.
Figure 10D:
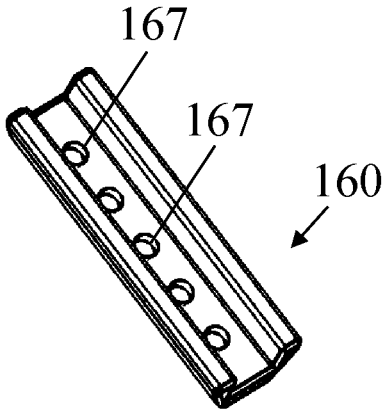
FIG. 10D is an enlarged perspective view of the accessories connector of FIG. 9C, according to an aspect of the disclosure.

In FIGS. 9A-E, two exemplary accessories connectors 160 are shown received within the same channel 121. FIG. 9C is a close-up view of the exemplary accessories connector 160 shown on the right in FIGS. 9A and 9B, having five holes 157 sized the same and evenly distributed in a consecutive fashion. These five holes 157 correspond with the holes 117 of the main body 112 in size and location. Any of these five holes 157 can receive a fastener 101 in both directions. In other words, although the figures show that only two of the fasteners 101 on the terminal ends are pointed downwards to screw into the main body 112, a user could use the same fastener 101 to screw into the main body 112 using any of the other holes 157. Similarly, although the figures show that only three of the fasteners 101 in the middle are pointed upwards to have their shanks extend away from the main body 112 (to attached to an accessory), a user could use the same fastener 101 using any of the other terminal holes 157 to attach to an accessory. More views of this exemplary accessories connector 160 are shown in FIGS. 10A-10D. Each of these holes 167 can have a countersink 169 on the underside of the accessories connector 160. It should be understood that in one particular embodiment where the holes 167 are threaded, when securing the accessories connector 160 in place within the channel 121. The fastener 101 pointing downwards does not necessarily have to be inserted into a corresponding hole 117 of the main body 112. In such particular embodiments the fastener 101 can push onto the channel floor 123 and can thereby push the accessories connector 160 upward to secure it in place. The embodiment shown in FIG. 9C, however, has five holes 167 that are not threaded. Instead, the holes 117 in the main body 112 are threaded. A fastener 101 can pass through a hole 167 on the accessories connector 160 and screw into the threaded hole 117 of the main body 112. It should also be noted that although FIG. 9C shows the center bore 114 being free of any core connector 140, a core connector 140 can be provided in the center bore 114.

As for FIG. 9D, it is a close-up view of the exemplary accessories connector 160 shown on the left side in FIGS. 9A and 9B. There are three holes 167 in the center portion of the accessories connector 160. These three holes 167 are not threaded in this particular embodiment as shown. Here, a total of four secondary holes 161 are located in the longitudinal midline of the accessories connector 160 thus any appropriately sized fastener 101 placed therethrough can potentially reach a hole 117 in the main body 112. Because such fasteners 101 is smaller than hole 117, they are not expected to securely engage with each other. The secondary holes 161, however, can be spaced apart from each other at a distance different from the distance between each holes 117 of the main body 112. This would allow at least one secondary hole 161 to be offset from the holes 117 of the main body 112. By doing so, at least one fastener 101 that points downward and fastens through the secondary hole 161 can directly abut against the channel floor 123 thereby pushes the accessories connector 160 upward to secure it in the channel 121. For this reason, the secondary holes 161 are threaded. As for any fastener 101 that points downward and fastens through the secondary hole 161 but does not directly abut against the channel floor 123 and is partially inserted into the hole 117 of the main body 112, such fastener 101 may not function to secure the accessories connector 160 in any way.

It is particularly contemplated that any of the holes 117 of the main body 112, any of the holes 157 of the binding connector 150, any of the holes 167 of the accessory connector 160, any of the holes on the connecting core 140, and any of the holes 177 of the end pieces can or cannot have threads. When any combination of the above parts is used in a system, it is particularly understood that any threaded and unthreaded combination is possible. For example, in an embodiment similar to what's shown in FIG. 9C, the fastener 101 on the far left may have a double threaded combination where the hole 167 of the accessories connector 160 and the hole 117 of the main body 112 are both threaded. Alternatively, as shown in FIG. 9C, only the hole 167 of the accessories connector 160 is threaded and the hole 117 of the main body 112 is not threaded. In another embodiment, the hole 167 of the accessories connector 160 is not threaded and the hole 117 of the main body 112 is threaded.

Figure 11A:
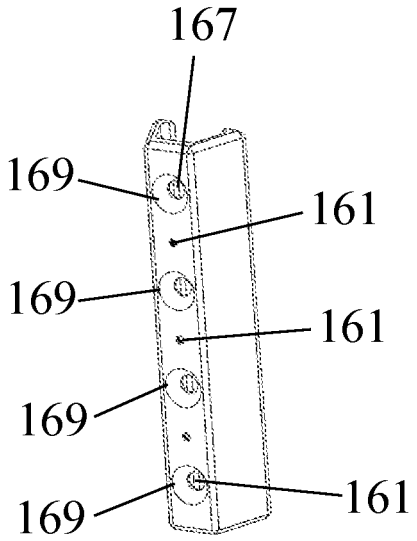
FIG. 11A is an enlarged bottom and side perspective view of one embodiment of an accessories connector, according to an aspect of the disclosure.
Figure 11B:
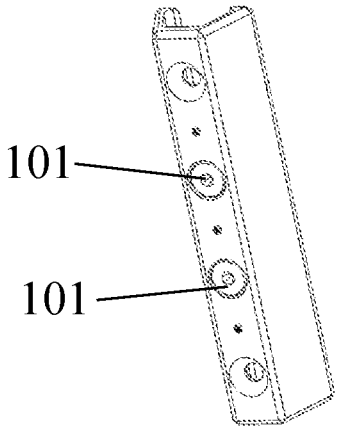
FIG. 11B is an enlarged bottom and side perspective view of the accessories connector of FIG. 11A with two fasteners in place, according to an aspect of the disclosure.
Figure 11C:
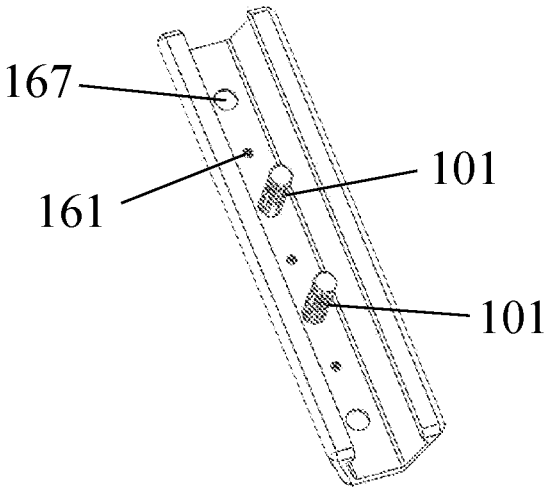
FIG. 11C is an enlarged top perspective view of the accessories connector of FIG. 11A with two fasteners in place, according to an aspect of the disclosure.

In FIGS. 11A-11C, another exemplary accessories connector 160 is shown to have holes 167 each with a countersink 169 and secondary holes 161. FIG. 11C shows the shank of two fasteners 101 to extend upward and away from the main body 112 of the support pillar 110. Smaller fasteners 101 could be inserted downward from the upside of the accessories connector 160 through secondary holes 161 and abutted against the channel floor 123 (not shown). The secondary holes 161 can be threaded, and these smaller fasteners 101 can in effect push the accessories connectors 160 upwards as similarly described for the accessories connector 160 of FIG. 9D.

Figure 12A:
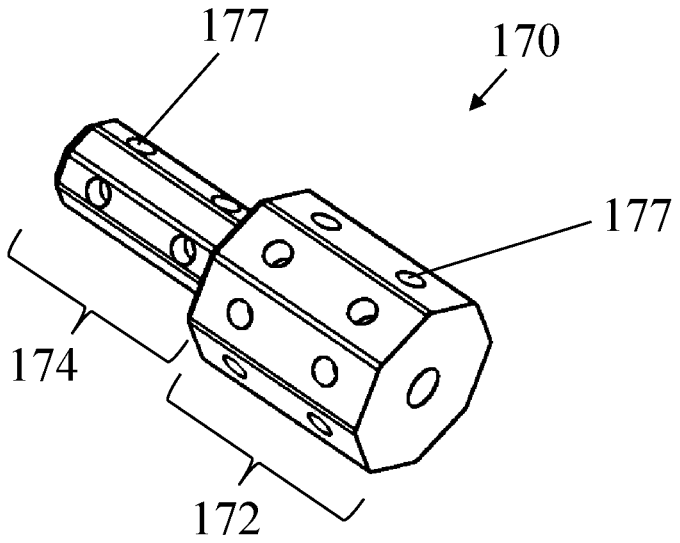
FIG. 12A is an enlarged perspective view of one embodiment of an end piece, according to one aspect of the disclosure.
Figure 12B:
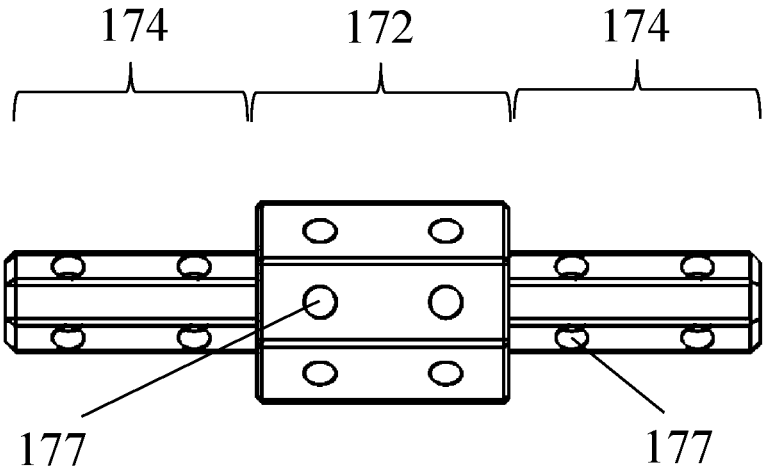
FIG. 12B is an enlarged perspective view of another embodiment of an end piece, according to one aspect of the disclosure.
Figure 12C:
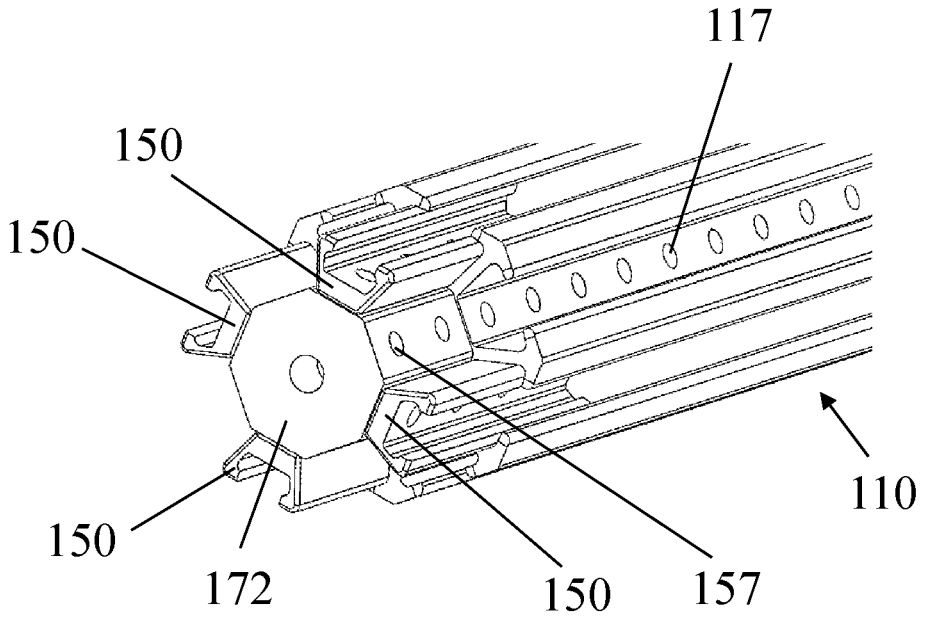
FIG. 12C is an enlarged perspective view of the end piece of FIG. 12A being attached to a terminal end of a support pillar, along with four connectors each partially received within a respective channel, according to one aspect of the disclosure.
Figure 13A:
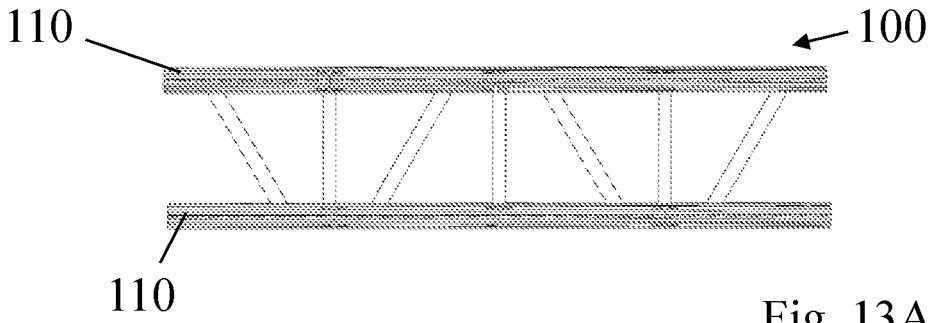
FIG. 13A illustrates two support pillars coupled in a parallel formation with accessories to become a Truss-like structure, according to one aspect of the disclosure.
Figure 13B:
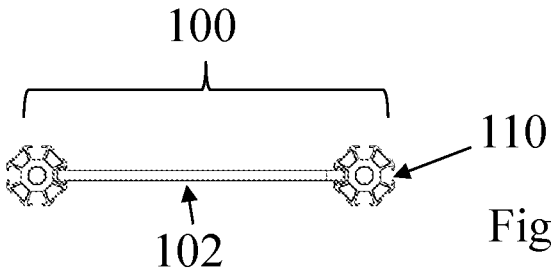
FIG. 13B illustrates how the two support pillars are coupled in FIG. 13A, according to one aspect of the disclosure.
Figure 14A:
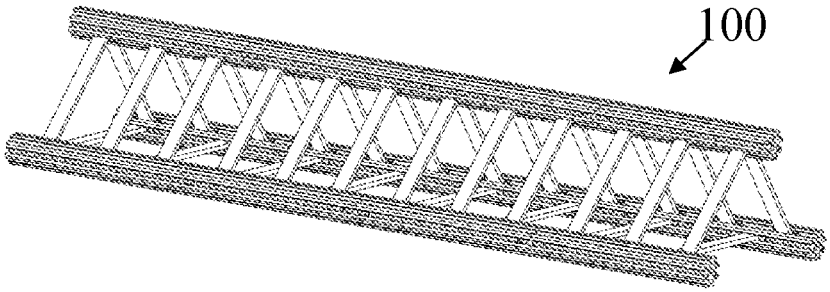
FIG. 14A illustrates three support pillars coupled in a parallel formation with accessories to become another Truss-like structure, according to one aspect of the disclosure.
Figure 14B:
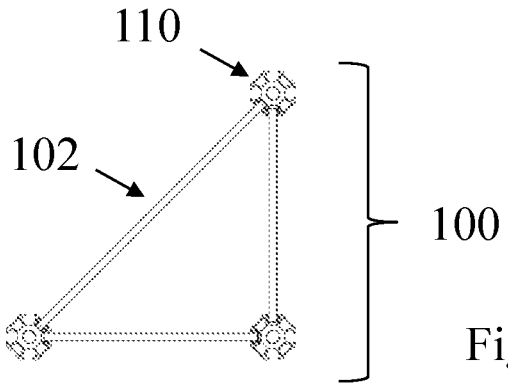
FIG. 14B illustrates how the three support pillars are coupled in FIG. 14A, according to one aspect of the disclosure.

There can be provided optional end pieces 170 in the contemplated modular framing system. FIGS. 12A-12C show two types of end piece 170. FIG. 12A shows an end piece 170 to have a head portion 172 and a core insert 174 attached thereto. FIG. 12B is similar except it has an additional core insert 174 disposed on the opposite end of the head portion 172. An end piece 170 is contemplated to have holes 177 disposed on the head portion 172 or the core insert 174, or both. The size and location of the holes 177 preferably correspond with the size and location of the holes 117 of the main body 112. FIG. 12C shows an end piece 170 coupled to a support pillar 110 and secured in place by four binding connectors 150. The exterior surface of the head portion 172 can correspond with the surface of the channel floor 123 such that the exterior surface of the head portion 172 is flush with the surface of the channel floor 123. On the exposed face 171 of the end piece there can be a mounting hole 179. The mounting hole 179 can be threaded to attach to an accessory.

The end piece 170 of FIG. 12B, on the other hand, can couple to two support pillars 110 on each end thereby connecting the two support pillars together. In this situation, four longer binding connectors 150 (not shown) can be used to bind the end piece 170 to the two support pillars 110.

Figure 15:
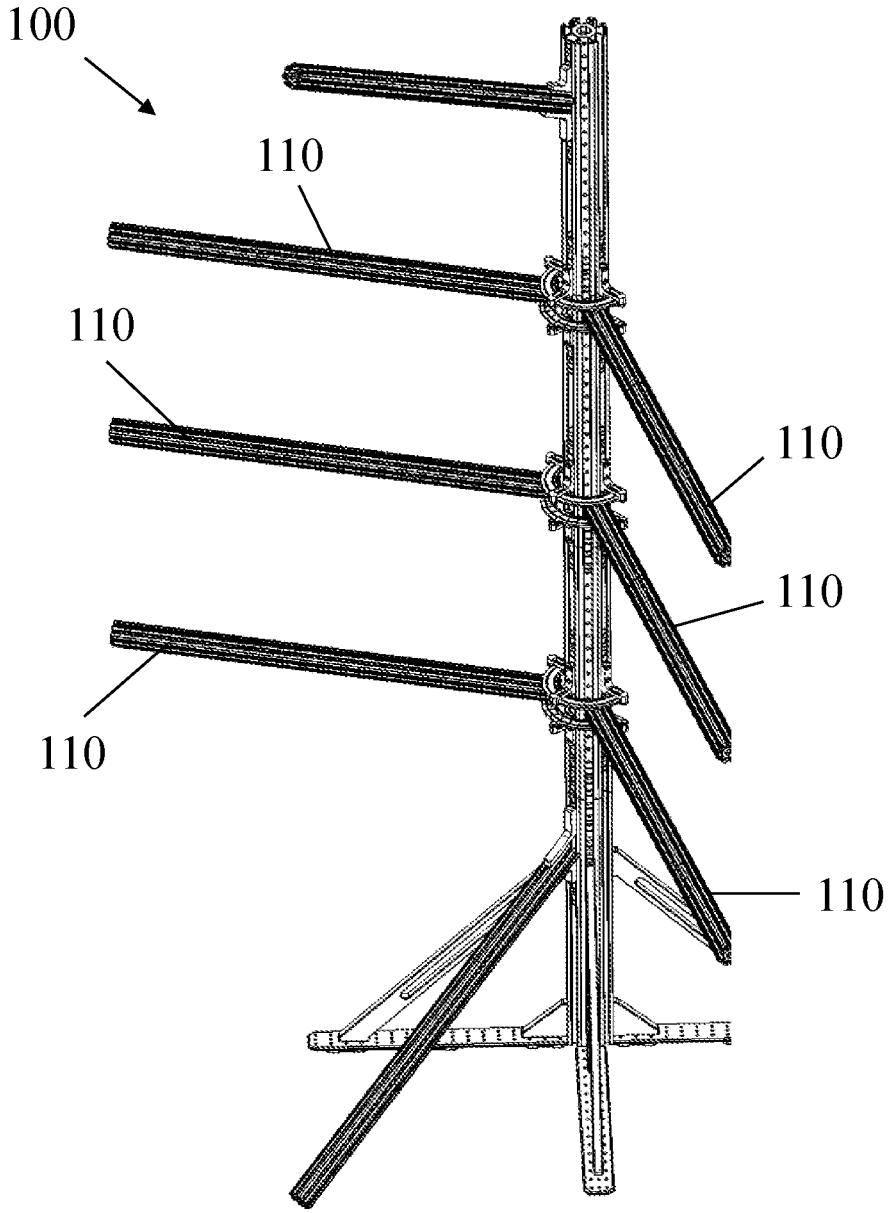
FIG. 15 is a perspective view of one embodiment of the modular framing structure, according to one aspect of the disclosure.

FIGS. 13A, 13B, 14A, 14B, and 15 illustrate the various uses of the above described parts in various applications. In FIGS. 13A, 13B, 14A, 14B, support pillars 110 can be coupled together in parallel by using an accessory 102 (i.e., angled plates) thereby creating a reinforced truss. In FIG. 15 the system can be used to create a structure for a display board or promotional screen.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of modular framing structure have been disclosed. The disclosed embodiments, therefore, are not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The definitions of the words or elements of the following claims therefore include not only the combination of elements which are literally set forth but also all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A support pillar, comprising:

a main body;

a plurality of channel walls outwardly radiating from an outside surface of the main body, wherein said plurality of channel walls are disposed lengthwise on the main body and defines a plurality of channels, and each of said plurality of channels has a channel floor which is a part of the outside surface of the main body; and a plurality of floor holes disposed and penetrating completely through a first channel floor, a second channel floor, and a third floor of said channel floors, wherein a first floor hole of said first channel floor, a second floor hole of said second channel floor, and a third floor hole of said third channel floor are aligned in a same plane;

wherein each of said plurality of channel walls has an expanded distal end defining at least two angled lips, respectively disposed on opposite sides of each respective channel wall.

2. The support pillar as recited in claim 1, wherein said first floor hole is threaded.

3. The support pillar as recited in claim 1 further comprising an anti-slip striation disposed on an exterior surface of the at least two lips.

4. The support pillar as recited in claim 1, wherein said first floor hole is sink or countersink.

5. The support pillar as recited in claim 1, wherein said first floor hole has a depth and a diameter, and a ratio of depth to diameter is between 0.8:1 and 3:1.

6. The support pillar as recited in claim 1, wherein one of said plurality of channels is configured to receive a connector, said connector has a connector hole, said connector hole is aligned with said first floor hole, and a fastener is inserted into both said connector hole and said first floor hole when said connector is received and fastened within the channel.

7. The support pillar as recited in claim 6, wherein said first floor hole corresponds with said connector hole in at least one of size, position, and thread.

8. The support pillar as recited in claim 6, wherein a cross-sectional profile of one of said plurality of channels corresponds with a cross-sectional outer profile of said connector in at least one of fitting or shape.

9. The support pillar as recited in claim 1, wherein the main body has a center bore configured to receive a connecting core, said connecting core has a connecting core hole, and a fastener is used to penetrating through said first floor hole and insert into said connecting core hole when said connecting core is inserted into said main body.

10. The support pillar as recited in claim 9, wherein said first floor hole corresponds with said connecting core hole in at least one of size and position.

11. The support pillar as recited in claim 9, wherein said connecting core is shorter than said support pillar and is configured to connect a first terminal end of said main body.

12. The support pillar as recited in claim 9, wherein said support pillar is made of a material softer than a material of said connecting core, and once said connecting core is received into said center bore, a structural integrity of said support pillar is improved.

13. A support pillar, comprising:

a main body;

a plurality of channel walls outwardly radiating from an outside surface of the main body, wherein said plurality of channel walls are disposed lengthwise on the main body and defines eight channels, and each of said eight channels has a channel floor which is a part of the outside surface of the main body; and a plurality of floor holes disposed and penetrating completely through a first channel floor, a second channel floor, and a third floor of said channel floors, wherein a first floor hole of said first channel floor, a second floor hole of said second channel floor, and a third floor hole of said third channel floor are aligned in a same plane;

wherein each of said plurality of channel walls has an expanded distal end defining at least two angled lips, respectively disposed on opposite sides of each respective channel wall.

* * * * *